US006866078B1

(12) United States Patent
Lin

(10) Patent No.: US 6,866,078 B1
(45) Date of Patent: Mar. 15, 2005

(54) SLIDING CARRIAGE FOR VERTICAL BLIND

(76) Inventor: Ya-Yin Lin, No. 598, Lu-Tsao, Hsi-Ching Tsun, Lu-Tsao Hsiang, Chia-Yi Hsien (TW)

( * ) Notice: Subject to any disclaimer, the term of this patent is extended or adjusted under 35 U.S.C. 154(b) by 0 days.

(21) Appl. No.: 10/728,008

(22) Filed: Dec. 3, 2003

(51) Int. Cl.[7] ..... E06B 9/38
(52) U.S. Cl. ..... 160/177 V
(58) Field of Search ..... 160/177 V, 176.1 V, 160/173 V, 168.1 V, 172 V, 178.1 V, 900

(56) References Cited

U.S. PATENT DOCUMENTS 3,996,988 A * 12/1976 de Wit ..... 160/168.1 R
4,316,493 A * 2/1982 Arena ..... 160/168.1 V
4,964,191 A * 10/1990 Wyatt ..... 16/87.2
5,067,544 A * 11/1991 Spohr et al. ..... 160/177 R
5,577,542 A * 11/1996 Hung ..... 160/177 V
6,321,821 B1 11/2001 Wünsche

* cited by examiner

*Primary Examiner*—David Purol
(74) *Attorney, Agent, or Firm*—Christie, Parker & Hale, LLP

(57) ABSTRACT

A sliding carriage for a vertical blind includes a main body, a slat hanging unit, and a clamp unit. The main body has bottom and side faces, and includes a receiving space, a first hole that opens in the bottom face and that is in communication with the receiving space, and a second hole that opens in one of the side faces and that intersects the first hole below the receiving space. The slat hanging unit includes a head portion inserted into the receiving space through the first hole, a clip connected to the head portion and extending outwardly of the main body, and a neck portion between the head portion and the clip. The clamp unit is inserted into the second hole, and holds rotatably the neck portion.

6 Claims, 5 Drawing Sheets

SLIDING CARRIAGE FOR VERTICAL BLIND

BACKGROUND OF THE INVENTION

1. Field of the Invention

The invention relates to a sliding carriage, more particularly to a sliding carriage for a vertical blind and movable within a support rail.

2. Description of the Related Art

Referring to FIG. 1, U.S. Pat. No. 6,321,821 discloses a slat carriage for hanging a slat 10 of a vertical blind. The slat carriage includes a main body 11 defining an interior apace, and a transmission mechanism 12 received in the interior space. The transmission mechanism 12 includes a toothed wheel 121 supported in the main body 11 and rotatable about a vertical axis, a pivot pin 122 connected to the toothed wheel 121 and inserted into the main body 11, and a clip 123 fixed on one end of the pivot pin 122 for hanging the slat 10.

During assembly, the toothed wheel 121 is disposed in the interior space of the main body 11 from a front or back side of the main body 11, after which the pivot pin 122 is inserted into an axial hole in the toothed wheel 121, and hence, the main body 11 through a hole in the bottom of the main body 11. However, it is difficult to insert the pivot pin 122 into the axial hole in the toothed wheel 121, and it is difficult to remove the pivot pin 122 from the axial hole in the toothed wheel 121 during disassembly. Furthermore, the toothed wheel 121 wears out easily because it meshes with related elements during rotation. Assembly and disassembly of the slat carriage are difficult such that repair of the same at a later stage is also difficult.

SUMMARY OF THE INVENTION

Therefore, the object of the present invention is to provide a sliding carriage that can be easily assembled and disassembled to facilitate repair at a later stage.

According to this invention, a sliding carriage for a vertical blind is movable within a support rail, and comprises a main body, a slat hanging unit, and a clamp unit. The main body is adapted to be mounted slidably within the support rail, and has a bottom face and two opposite side faces. The main body includes a receiving space, a first hole that opens in the bottom face and that is in communication with the receiving space, and a second hole that opens in at least one of the side faces and that intersects the first hole below the receiving space. The slat hanging unit includes a head portion, a clip, and a neck portion. The head portion is rotatable about a vertical axis, and is inserted into the receiving space through the first hole. The clip is connected to the head portion, and extends outwardly of the main body. The neck portion is disposed between the head portion and the clip. The clamp unit is inserted into the second hole, and holds rotatably the neck portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
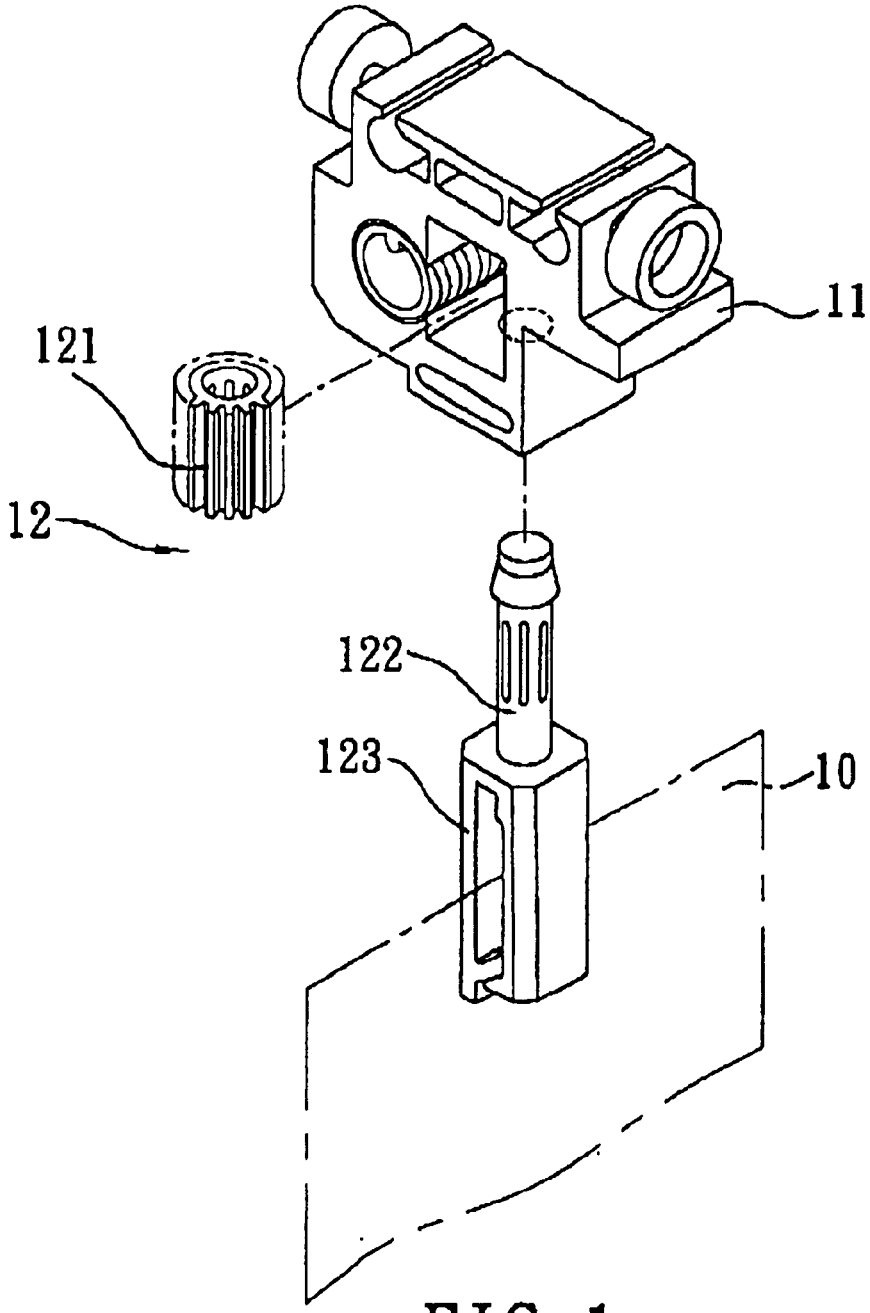
FIG. 1 PRIOR ART
FIG. 1 is a partly exploded perspective view of a slat carriage disclosed in U.S. Pat. No. 6,321,821.

Referring to FIGS. 2 to 6, the preferred embodiment of a sliding carriage according to the present invention is adapted for hanging a slat 20 of a vertical blind (not shown), and is shown to comprise a main body 3, a slat hanging unit 4, a clamp unit 5, a driving unit 6, and two wheels 7.

Figure 2:
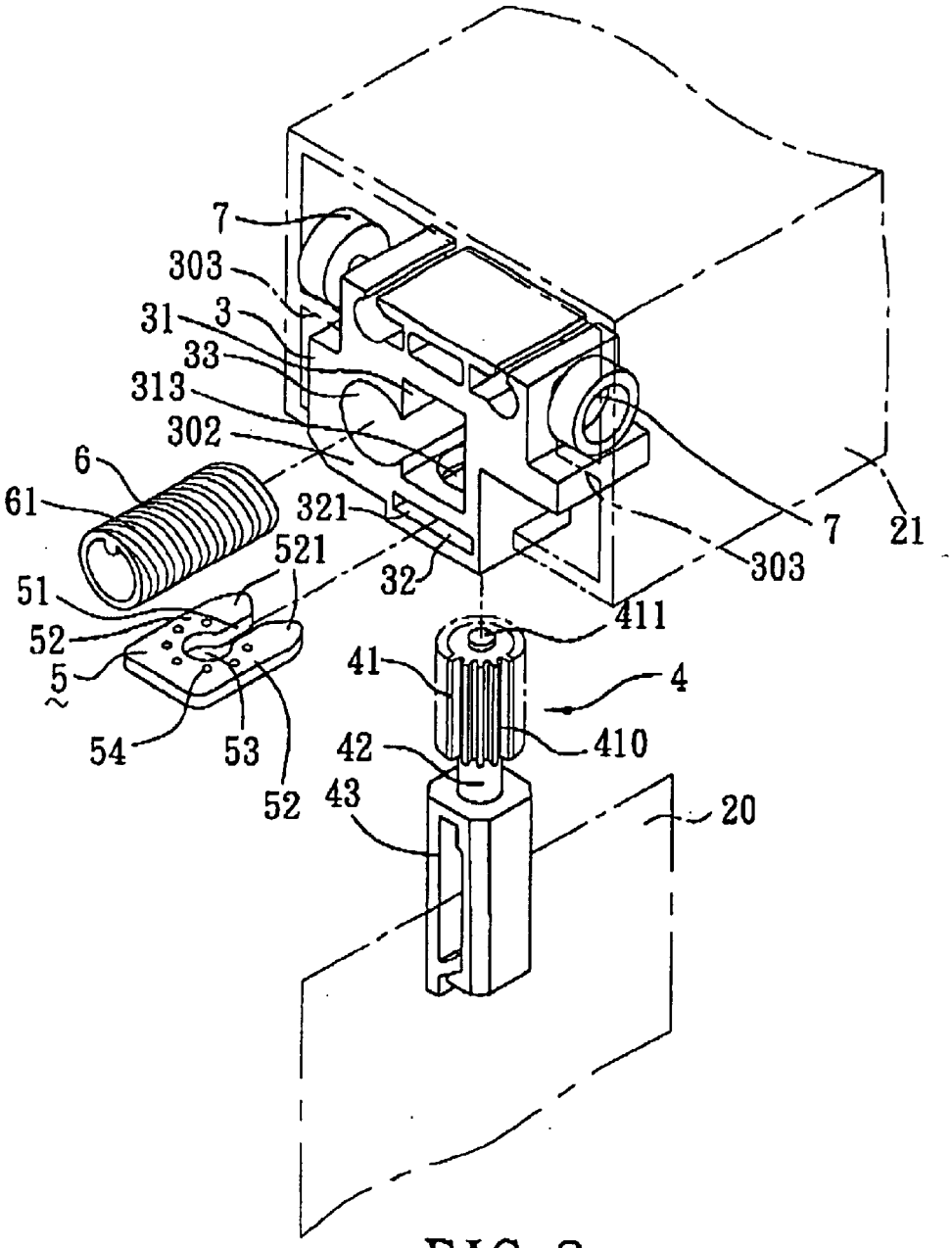
FIG. 2 is a partly exploded perspective view of the preferred embodiment of a sliding carriage according to the present invention.

The main body 3 is adapted to be mounted slidably within the support rail 21, and has a bottom face 301 (see FIG. 3) and two opposite side faces 302 (only one is visible in FIG. 2). The main body 3 includes a receiving space 31, a first hole 313 that opens in the bottom face 301 and that is in communication with the receiving space 31, a second hole 32 that opens in the side faces 302 and that intersects the first hole 313 below the receiving space 31, and a third hole 33 that opens in the side faces 302 and that is in communication with the receiving space 31. The second hole 32 has two open ends 321 (only one is visible in FIG. 2) which extend respectively through the side faces 302. The main body 3 further includes a stop member 304 (see FIG. 5) formed within the second hole 32 and connected to one of the side faces 302. The stop member 304 divides one of the open ends 321 into two openings 322 (see FIGS. 4 and 5), and has two abutment faces 305 (see FIG. 5).

The slat hanging unit 4 includes a head portion 41, a clip 43, and a neck portion 42. The head portion 41, in this embodiment, has gear teeth 410, and is rotatable about a vertical axis. The head portion 41 is inserted into the receiving space 31 through the first hole 313, and has a protruding spindle 411 on a top end thereof. The spindle 411 is received in a groove 311 formed in an inner wall of the main body 3 which defines the receiving space 31. The clip 43 is connected integrally to the head portion 41, and extends outwardly of the main body 3 for hanging the slat 20 of the blind. The neck portion 42 is disposed between the head portion 41 and the clip 43.

The clamp unit 5 is inserted into the second hole 32 in the main body 3, and holds rotatably the neck portion 42 of the slat hanging unit 4. The clamp unit 5, in this embodiment, is formed as a plate having a pair of interconnected opposite arms 52 that define therebetween a substantially circular slot 53 for receiving rotatably the neck portion 42 of the slat hanging unit 4, and an elongated slit 51 connected to and extending outwardly from the slot 53. The slit 51 is narrower than the slot 53. The arms 52 have distal ends 521 abutting respectively against the abutment faces 305 of the stop member 304. A plurality of protrusions 54 are formed on a top surface of the clamp unit 5.

The driving unit 6 is inserted into the third hole 33 in the main body 3, and can be rotated by an external force. In this embodiment, the driving unit 6 is a worm 61 that meshes with the gear teeth 410 of the head portion 41 of the slat hanging unit 4. When the worm 61 is rotated so as to rotate the head portion 41, the slat 20 is moved to a predetermined angle so as to adjust a shielding angle of the slat 20.

The wheels 7 are mounted respectively on two opposite sides of the main body 3 to roll on support seats 303 of the support rail 21. Since the wheels 7 are elements commonly seen in a conventional eliding carriage, a detailed description of the same will be dispensed herewith for the sake of brevity.

Figure 5:
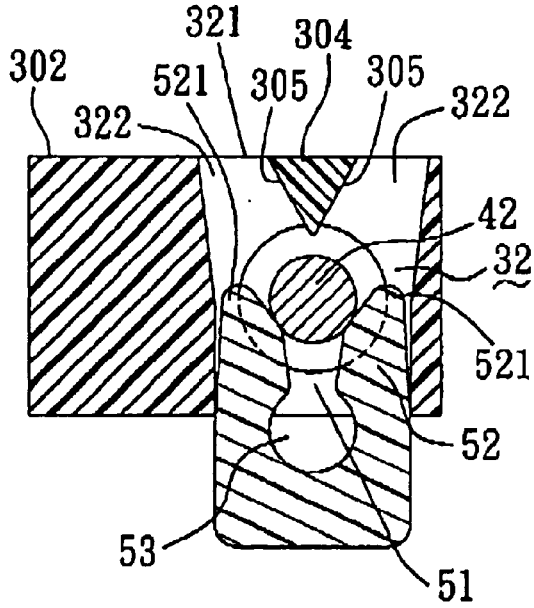
FIG. 5 is a sectional view of the preferred embodiment, illustrating how a clamp unit is inserted into a second hole in the main body.
Figure 6:
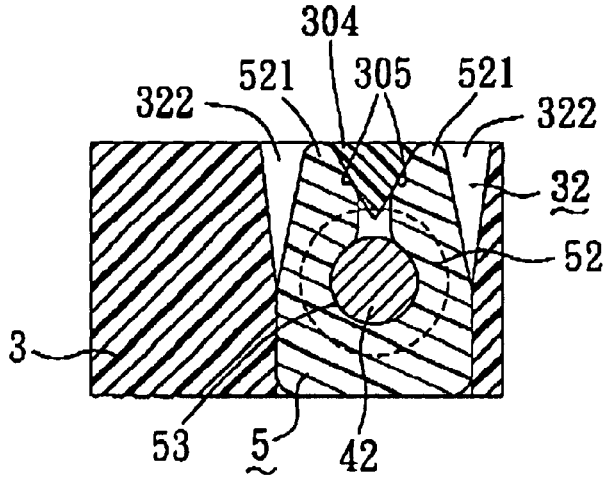
FIG. 6 is a sectional view taken along line VI—VI of FIG. 3.

When the clamp unit 5 is inserted into the second hole 32 in the main body 3, the arms 52 of the clamp unit 5 initially slide on two sides of the neck portion 42 of the slat hanging unit 4 so that the slit 51 between the arms 52 is enlarged, as best shown in FIG. 5. Thereafter, the arms 52 move further into the respective openings 322. At this time, the slot 53 receives fittingly and rotatably the neck portion 42, and the distal ends 521 of the arms 52 abut respectively against the abutment faces 305 of the stop member 304, as best shown in FIG. 6.

Figure 3:
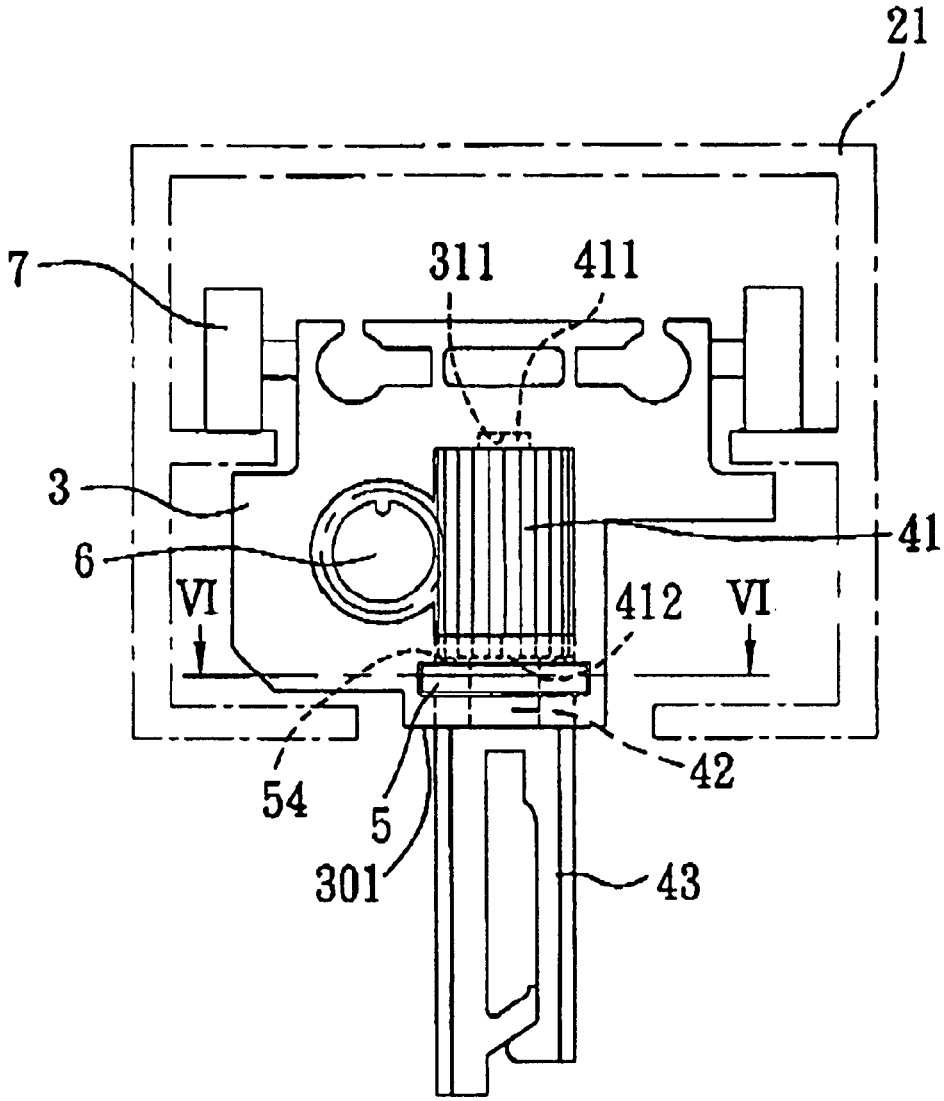
FIG. 3 is a schematic side view of the preferred embodiment in an assembled state.
Figure 4:
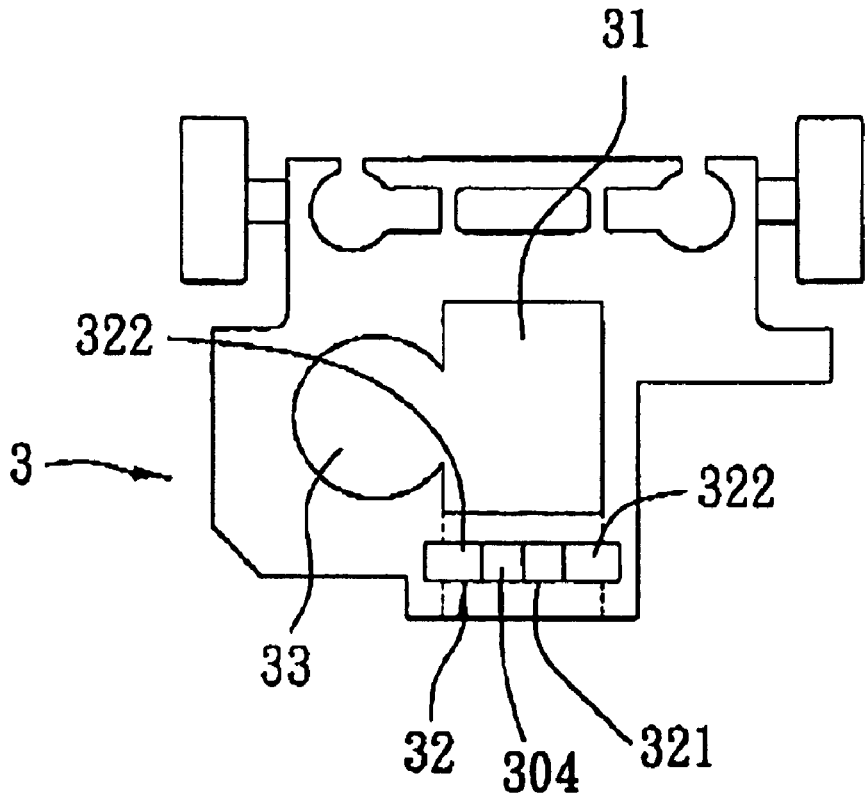
FIG. 4 is a side view of a main body of the preferred embodiment.

After the clamp unit 5 is inserted into the second hole 32 in the main body 3, the protruding spindle 411 of the head portion 41, as shown in FIG. 3, is received rotatably in the groove 311 in the main body 3, and the neck portion 42 of the slat hanging unit 4 is clamped by the clamp unit 5 within the slot 53 so that the slat hanging unit 4 can rotate within the main body 3, but is restricted from moving upward and downward or leftward and rightward. The protrusions 54 of the clamp unit 5 abut against a bottom surface 412 of the head portion 41 at this time so as to reduce friction between the bottom surface 412 of the head portion 41 and a top surface of the clamp unit 5.

To assemble the sliding carriage of the present invention, the slat hanging unit 4 is simply inserted into the receiving space 31 in the main body 3 through the first hole 313, after which the clamp unit 5 is inserted into the second hole 32 so as to clamp rotatably the slat hanging unit 4 within the main body 3.

When the head portion 41 of the slat hanging unit 4 wears out or the clamp unit 5 is damaged, these elements can be replaced or repaired easily. To this end, a thin elongated tool can be used to push the distal ends 521 of the arms 52 of the clamp unit 5 away from the respective opening 322 and out of the second hole 32 so that the clamp unit 5 can be removed from the main body 3 to subsequently remove the slat hanging unit 4 from the main body 3, From the aforementioned description of the preferred embodiment, it is apparent that, through the clamp unit 5, the slat hanging unit 4 can be retained rotatably on the main body 3. The clamp unit 5 and the slat hanging unit 4 are easily removed for replacement or repair, such that assembly and disassembly of the sliding carriage of the present invention are quite simple.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A sliding carriage for a vertical blind, said sliding carriage being movable within a support rail, and comprising:

a main body adapted to be mounted slidably within the support rail and having a bottom face and two opposite side faces, said main body including a receiving space, a first hole that opens in said bottom face and that is in communication with said receiving space, and a second hole that opens in at least one or said side faces and that intersects said first hole below said receiving space;

a slat hanging unit including a head portion rotatable about a vertical axis and inserted into said receiving space through said first hole, a clip connected to said head portion and extending outwardly of said main body, and a neck portion between said head portion and said clip; and a clamp unit inserted into said second hole and holding rotatably said neck portion.

2. The sliding carriage as claimed in claim 1, wherein said main body further includes a third hole that opens in both of said side faces and that is in communication with said receiving space, said sliding carriage further comprising a driving unit inserted into said third hole for rotating said head portion.

3. The sliding carriage as claimed in claim 2, wherein said head portion has gear teeth, said driving unit being a worm meshing with said gear teeth to rotate said head portion.

4. The sliding carriage as claimed in claim 1, wherein said clamp unit is formed as a plate having a pair of interconnected opposite arms that define therebetween a substantially circular slot for receiving rotatably said neck portion, and an elongated slit connected to and extending outwardly from said slot, said slit being narrower than said slot.

5. The sliding carriage as claimed in claim 4, wherein said second hole has two open ends which extend respectively through said side faces, said main body further including a stop member formed within said second hole and connected to one of said side faces, said stop member dividing one of said open ends into two openings at said one of said side faces, said stop member having two abutment faces, said arms having distal ends to abut respectively against said abutment faces.

6. The sliding carriage as claimed in claim 1, wherein said head portion has a protruding spindle on a top end thereof, said main body further having an inner wall which defines said receiving space and which is formed with a groove for receiving said spindle.

* * * * *